United States Patent [19]

Junghans

[11] Patent Number: 4,495,864

[45] Date of Patent: Jan. 29, 1985

[54] INK KNIFE AND ADJUSTING DEVICE THEREFOR ON AN INK DUCT OF A ROTARY PRINTING MACHINE

[75] Inventor: Rudi Junghans, Wilhelmsfeld, Fed. Rep. of Germany

[73] Assignee: Heidelberger Druckmaschinen AG, Heidelberg, Fed. Rep. of Germany

[21] Appl. No.: 463,330

[22] Filed: Feb. 2, 1983

[30] Foreign Application Priority Data

Feb. 3, 1982 [DE] Fed. Rep. of Germany ..... 3203500

[51] Int. Cl.[3] ..... B41F 31/04; B41F 31/06; B41L 27/06

[52] U.S. Cl. ..... 101/365

[58] Field of Search ..... 101/365, 350, 363, 364, 101/148, 207, 208, 209, 210

[56] References Cited

U.S. PATENT DOCUMENTS

| | | | |
|---|---|---|---|
| 2,837,024 | 6/1958 | Dougan | 101/365 |
| 3,696,743 | 10/1972 | Johne et al. | 101/365 |
| 3,822,642 | 7/1974 | Grindeland | 101/169 X |
| 3,855,927 | 12/1974 | Simeth | 101/365 X |
| 4,242,958 | 1/1981 | Jeschke et al. | 101/365 |

FOREIGN PATENT DOCUMENTS

| | | | |
|---|---|---|---|
| 2305831 | 8/1974 | Fed. Rep. of Germany | 101/365 |
| 2931579 | 2/1981 | Fed. Rep. of Germany | 101/365 |
| 2220381 | 10/1974 | France | 101/365 |

*Primary Examiner*—J. Reed Fisher

*Attorney, Agent, or Firm*—Herbert L. Lerner; Laurence A. Greenberg

[57] ABSTRACT

An ink duct assembly of a rotary printing machine having an ink duct formed with an ink duct roller, the improvement therein including an ink knife having a wiper edge and being divided into individually controllable zonewide tongues in vicinity of the wiper edge, and adjusting means for adjusting a gap width between the wiper edge and the ink duct roller, the tongues having slits therebetween which are very narrow compared to the width of the tongues, the tongues being positionable by the adjusting means starting from a uniform zero position, and the tongues being covered with an elastic covering formed of a thin, hard and elastic foil having a smooth surface, and having a part thereof overlapping the wiper edge and engaging tangentially with the ink duct roller, the elastic covering, at a forward region thereof, being bent at an angle towards the ink duct roller so as to wipe excessive ink emerging from the ink duct onto the wiper edge back onto an ink film on the ink duct roller.

8 Claims, 3 Drawing Figures

INK KNIFE AND ADJUSTING DEVICE THEREFOR ON AN INK DUCT OF A ROTARY PRINTING MACHINE

The invention relates to an ink knife and an adjusting device for the ink knife on the ink duct of rotary printing machines, the ink knife being formed with separately controllable zone-wide tongues engageable by adjusting means for adjusting a gap between a wiper edge on the ink knife and an ink duct roller, the tongues having an elastic covering.

A heretofore known embodiment of a device of this general type (U.S. Pat. No. 2,837,024) employs a thin spring-steel knife having a rubber film or foil vulcanized thereon in vicinity of the slits formed between the tongues. This heretofore known construction has the disadvantage that in the region of the relatively wide slits, the rubber film or foil is forced off the duct roller by the back-pressure of the ink with the result that an uncontrolled streak of ink penetrates into the inking unit. Furthermore, the wear behavior of a rubber film or foil and a spring-steel knife is so different that sealing problems may thereby also occur at the ink duct roller. A considerable disadvantage of the heretofore known construction is that, with the inking zone disengaged, the printer cannot tell with what force he is engaging the individual zone against the ink duct roller my means of the adjusting elements, so that greater wear must be expected. In this case, the ink knife must be reground or it will become unserviceable together with the film or foil vulcanized thereon. This increases the outlay and, therewith the costs for the practical use of the heretofore known construction. With the heretofore known construction there is also no possibility of effecting a reproducible setting or adjustment of the ink knife because no basic setting or adjustment of all the wiper edges is possible.

It is accordingly an object of the invention to provide an ink knife and an adjusting device for the latter which, with relatively low outlay or expense, can perform optimum inking control, and, for the necessary adjustment operations, will require a very small expenditure of time only during installation. A further object is to provide such a construction which will prevent fouling of the adjusting means on the ink duct by ink.

With the foregoing and other objects in view there is provided, in accordance with the invention, an ink duct assembly of a rotary printing machine having an ink duct formed with an ink duct roller, the improvement therein includes an ink knife having a wiper edge and being divided into individually controllable zonewide tongues in vicinity of the wiper edge, and adjusting means for adjusting a gap width between said wiper edge and the ink duct roller, the tongues having slits therebetween which are very narrow compared to the width of the tongues, the tongues being positionable by the adjusting means starting from a uniform zero position and the tongues being convered with an elastic covering formed of a thin, hard and elastic foil having a smooth surface, and having a part thereof overlapping the wiper edge and engaging tangentially with the ink duct roller, the elastic covering, at a forward region thereof, being bent at an angle towards the ink duct roller so as to wipe excessive ink emerging from the ink duct onto the wiper edge back onto an ink film on the ink duct roller.

With the ink knife according to the invention, it is possible to provide a precisely reproducible setting of the ink quantity to be transferred into the inking unit in each zone. The film or foil which projects beyond or overlaps the wiper edge reliably prevents fouling of parts of the adjusting device by ink and exhibits little wear at the metering or dosing edge thereof. Should damage to the film or foil occur, for example, due to incorrect use of an ink palette knife, the film or foil can be exchanged relatively simply, and the new film or foil immediately again provides the original zero position.

The individual tongues of the ink knife according to the invention can be set or adjusted extremely accurately by remote control with the result that the ink quantity can be regulated without any problem. Very narrow slits in the ink knife permit the use of thin films or foils without any bulging of the latter into the slits. The smooth surface of the film or foil prevents dirt particles from sticking in front of the metering or dosing gap. The uniform zero position which can be achieved by the adjusting means prevents excessively hard or forceful engagement of the zones and, consequently, undesired wear of the film or foil. Furthermore, this provides advantages with regard to the remote control.

In accordance with another feature of the invention the slits between the tongues are in a forward region of the ink knife and are less than one millimeter wide, and the foil is formed of a substance selected from the group consisting of polyesters and polyimides.

In accordance with a further feature of the invention the slits are 0.2 mm wide.

The use of very thin films is therefore afforded and, due to the angle effect, the ink creeping along the film is fed to the ink duct roller so that downward dripping thereof is reliably prevented.

In accordance with an additional feature of the invention there is provided a mounting rail secured by adhesive to the ink knife at a rearward region thereof, the mounting rail, in turn, being fastened to the ink duct.

In accordance with again another feature of the invention the slits between the tongues extending from the wiper edge to the mounting rail.

In accordance with still a further feature of the invention there is provided an ink knife for an ink duct of a rotary printing machine in combination with an adjusting device therefor and including a flat blade-like plate formed with a wiper edge and divided into zonewide tongues in vicinity of the wiper edge, the adjusting device including an eccentric adjusting element for positioning each of the tongues, the adjusting element being pivotally mounted by a pivot on the ink duct, the pivot being adjustable for producing a uniform zero position.

In accordance with again another feature of the invention there is provided a crosshead pin braced by a spring on the ink duct, the pivot of the adjusting element being mounted in the crosshead pin, the crosshead pin having a nut threadedly mounted thereon for axially adjusting the position of the crosshead pin.

In accordance with a concomitant feature of the invention there are provided eccentric sections disposed on the adjusting element for zonewise control of the ink knife, the eccentric sections bordering on a region having a given radius with respect to the pivot for limiting displacement of the tongues.

Other features which are considered as characteristic for the invention are set forth in the appended claims.

Although the invention is illustrated and described herein as embodied in an ink knife and adjusting device therefor on an ink duct of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
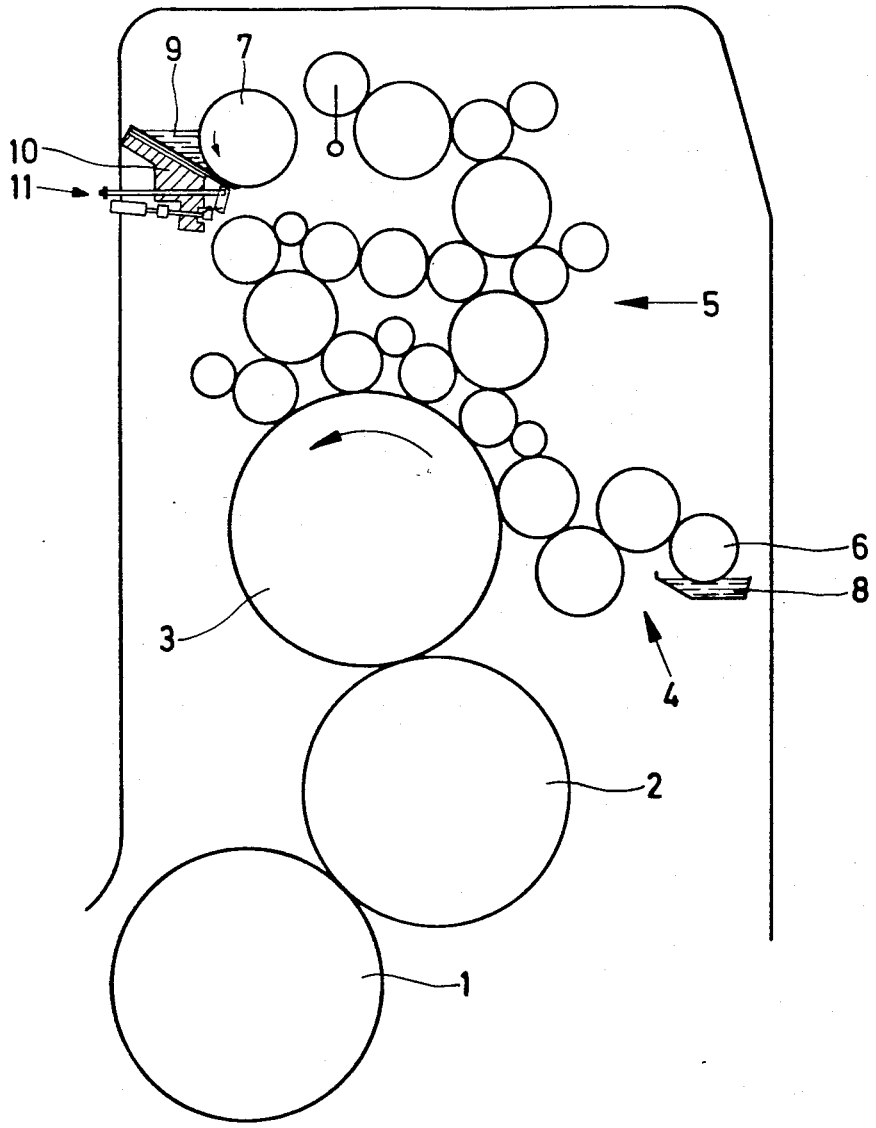
FIG. 1 is a diagrammatic side elevational view of an offset printing unit embodying an ink duct with an ink knife and adjusting device therefor in accordance with the invention.

Referring now to the drawing and first, particularly, to FIG. 1 thereof, there is shown, in a side elevational view of an offset printing unit, sheets being printed passing in a conventional manner between a printing or impression cylinder 1 and a blanket or rubber-covered cylinder 2. The blanket cylinder 2 cooperates with a plate cylinder 3 which is provided with dampening medium and ink by a dampening unit 4 and an inking unit 5, respectively. The construction of the dampening and the inking units is of modern design, the dampening medium 8 being fed to rollers of the dampening unit 4 by a dampening ductor 6, and the ink 9 being fed to rollers of the inking unit 5 by an inking unit roller 7. Provided on the ink duct 10 and extending parallel to the ink duct roller 7 for zone-wise adjustment of the ink quantity are a multiplicity of adjusting devices 11 with which the ink quantity being transferred into the inking unit 5 can be regulated zonewise in a conventional manner.

Figure 2:
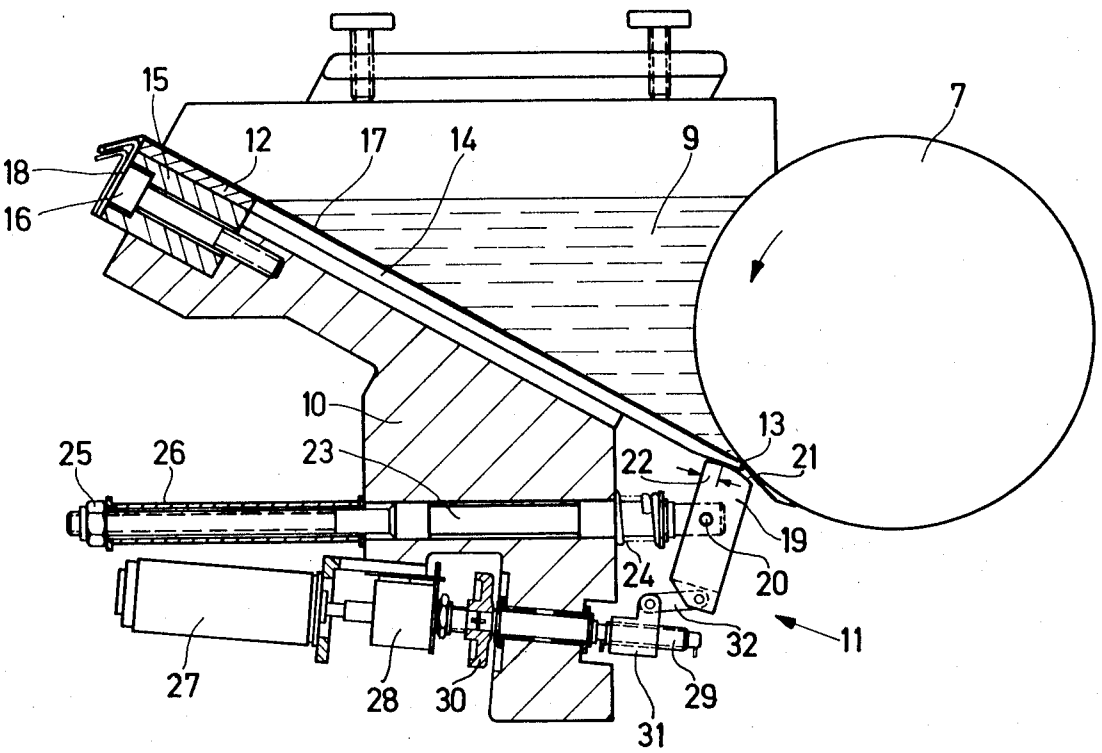
FIG. 2 is an enlarged fragmentary view of FIG. 1 showing in partial cross-section the ink duct in greater detail.
Figure 3:
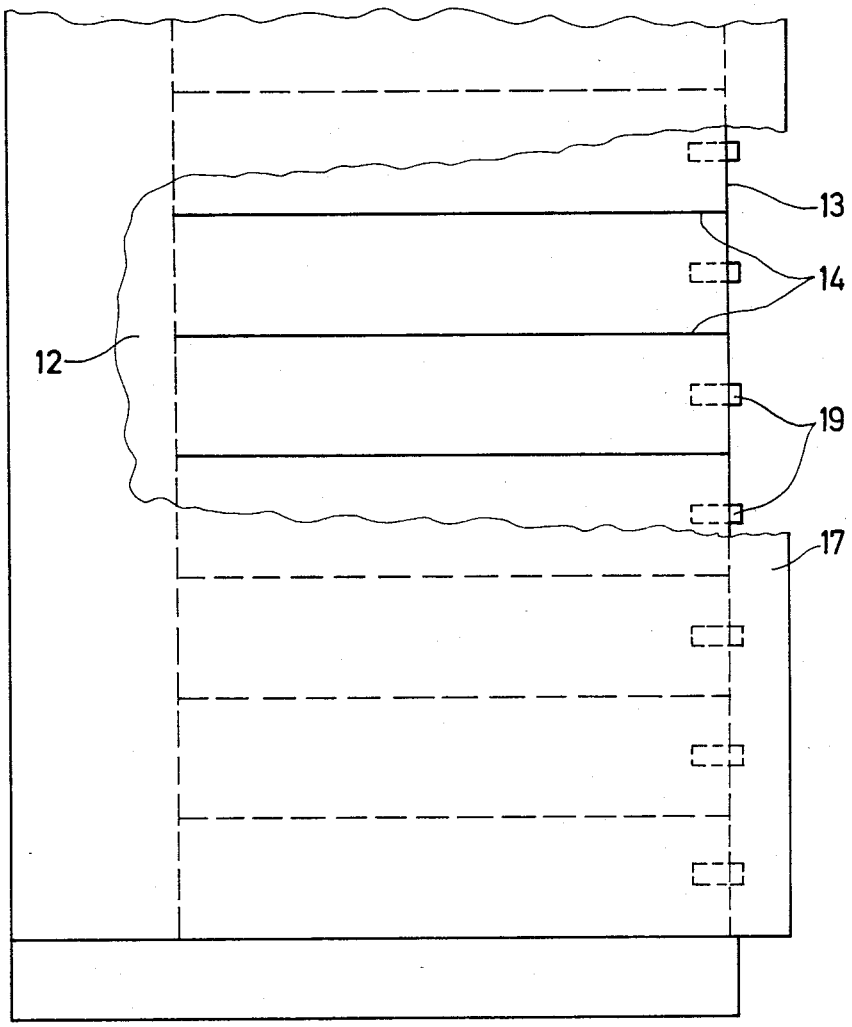
FIG. 3 is a top plan view of the ink knife with a superposed film or foil according to the invention.

As can be seen from FIG. 2, the ink 9 is regulated by an ink knife 12 which is plate-shaped and extends along the length of the ink duct roller 7. In the case of large widths of the printing machine, it is also possible to provide several ink knives side by side. In the region of the wiper or squeegee edge 13 of the ink knife 12 up to about the illustrated surface of the ink 9, the ink knife 12 is divided zone-wise by slits 14 of very small width into tongues having a width of approximately 30 mm each. The slits 14 provided in the front region of the ink knife 12 are less than 1 mm wide and are preferably produced in a width of about 0.2 mm (see FIG. 3) by means of laser beams. In the non-slitted region thereof, the the ink knife 12 is bonded onto a mounting or support rail 15 which, in turn, is fastened to the ink duct 10 by means of screws 16.

The entire length and width of the ink knife 12 is provided with an elastic covering formed of a thin, hard and elastic foil or film 17 having a smooth surface. The foil or film 17 is formed preferably of polyester or polyimide and projects beyond the wiper edge 13 of the ink knife 12. In the projecting part thereof, the film or foil engages the ink duct roller 7 tangentially, and the front region thereof extends at an angle towards the ink duct roller 7. This makes it possible for uncontrolledly discharging drops of ink to be fed back to the outer cylindrical surface of the ink duct roller 7 so that a fouling or soiling of the inking unit is prevented. To permit easy replacement of the foil or film 17, the rear region of the latter is hooked over or along the length thereof into rear brackets 18 which are fastened to the mounting rail 15.

The adjusting device for the ink knife in the illustrated embodiment of the invention is in the form of adjusting devices 11 by means of which each zone-wide tongue of the ink knife 12 can be adjusted to a precise and reproducible gap with respect to the outer cylindrical surface of the ink duct roller 7. To this end, each tongue rests on an eccentric adjusting element 19 and can be precisely positioned by turning the adjusting element 19.

The eccentric adusting element 19 is mounted on the ink duct 10 by means of a pivot point 20, a contact face 21 of the adjusting element 19 being eccentric in form. Consequently, the position of the wiper edge 13 is moved to a greater or lesser extent towards the outer cylindrical surface of the ink duct roller 7. In order to limit the stroke, the eccentric contact face 21 borders on an area 22 having a given radius with respect to the pivot point 20 of the adjusting element 19. This prevents the wiper edge 13 from being pressed against the outer cylindrical surface of the ink duct roller 7 so as to damage the film or foil 17 in this region. The maximum setting or adjustment of the wiper edge is such that a sufficient film or foil thickness is always maintained.

The pivot point 20 for the adjusting element 19 is mounted in a crosshead pin 23 which is braced against the ink duct 10 by springs 24. By means of a nut 25, the crosshead pin is shiftable in a longitudinal direction and, consequently, during installation, for the one and only time, the basic setting of the pivot point 20, is changeable, for example, in order to compensate for production tolerances. The nut 25 is supported on the ink duct 10 by means of a bushing 26. Therewith, each individual zone along the length of the ink knife 12 may be adjusted to absolutely the same zero or neutral position with respect to the ink duct roller 7, in a relatively simple manner. This is performed only once during installation, as follows: without any foil or film 17 inserted, the location of each wiper edge 13 is adjusted to a precise extent with respect to the outer cylindrical surface of the ductor roller 7, the distance of the wiper edge 13 from the outer cylindrical surface corresponding to about 50% of the film thickness. The respective individual zone of the ink knife 12 is then preloaded or prestressed to a corresponding extent.

The distance or gap between the wiper edge 13 and the ink duct roller 7 is adjusted by the adjusting element 19 through the action of a servomotor 27 which, by means of a potentiometer 28, for position-indicating, turns a threaded stem 29 which is mounted in the ink duct 10. The threaded stem 29 may also be turned manually by means of a handwheel 30. When the threaded stem 29 is turned, a threaded bushing 31 is caused to move in axial direction of the threaded stem 29, and the movement is transmitted via a strap 32 to the adjusting element 19, and the latter swivels about the pivot point 20. Owing to the preload or prestressing with which the ink knife 12 rests against the contact face 21 of the adjusting element 19, this movement results in an exact change in the ink gap. Instead of the eccentric contact face 21, it is also possible to use other means, such as small rollers, for example, whereon the tongues of the ink knife 12 rest. The adjusting element 19 is doubly guided by the strap 32 and the crosshead pin 23 so that tilting or tipping thereof is prevented. The servomotor 27 may be connected in a conventional manner to a remote control device so that the setting or adjustment of the ink knife 12 selected for a given printing run is reproducible at any time.

The foregoing is a description corresponding to German Application P 32 03 500.4, dated Feb. 3, 1982, the International priority of which is being claimed for the instant application, and which is hereby made part of this application. Any discrepancies between the foregoing specification and the aforementioned corresponding German application are to be resolved in favor of the latter.

I claim:

1. In an ink duct assembly of a rotary printing machine having an ink duct formed with an ink duct roller, the improvement therein comprising an ink knife having a wiper edge and being divided into individually controllable zonewide tongues in vicinity of said wiper edge, and adjusting means for adjusting a gap width between said wiper edge and said ink duct roller, said tongues having slits therebetween which are very narrow compared to the width of said tongues, said tongues being positionable by said adjusting means starting from a uniform zero position, and said tongues being covered with an elastic covering formed of a thin, hard and elastic foil having a smooth surface and having a part thereof overlapping said wiper edge and engaging tangentially with said ink duct roller, said elastic covering, at a forward region thereof, being bent at an angle towards said ink duct roller so as to wipe excessive ink emerging from the ink duct onto said wiper edge back onto an ink film on said ink duct roller.

2. Ink knife according to claim 1 wherein said slits between said tongues are in a forward region of the ink knife and are less than one millimeter wide, and said foil is formed of a substance selected from the group consisting of polyesters and polyimides.

3. Ink knife according to claim 2 wherein said slits are 0.2 mm wide.

4. Ink knife according to claim 1 including a mounting rail secured by adhesive to the ink knife at a rearward region thereof, said mounting rail, in turn, being fastened to said ink duct.

5. Ink knife according to claim 4 wherein said slits between said tongues extending from said wiper edge to said mounting rail.

6. Ink knife for an ink duct of a rotary printing machine according to claim 1 in combination with an adjusting device therefor, said adjusting device including an eccentric adjusting element for positioning each of said tongues, said adjusting element being pivotally mounted by a pivot on the ink duct, and means for adjusting said pivot for producing a uniform zero position.

7. Adjusting device according to claim 6 including a crosshead pin disposed on the ink duct so as to be axially displaceable towards and away from each of said tongues, said pivot of said adjusting element being mounted in said crosshead pin, said crosshead pin being spring-biased against axial displacement towards the respective tongue and having a nut threadedly mounted thereon and turnable in a direction to over-ride the spring bias for axially adjusting the position of said crosshead pin.

8. Adjusting device according to claim 6 including eccentric sections disposed on said adjusting element for zonewise control of the ink knife, said eccentric sections bordering on a region having a given radius with respect to said pivot for limiting displacement of said tongues.

* * * * *